US007377692B1

(12) United States Patent
Troncoso et al.

(10) Patent No.: US 7,377,692 B1
(45) Date of Patent: May 27, 2008

(54) THERMAL INSULATIVE DEVICE AND METHOD

(76) Inventors: Hugo Troncoso, 701 N. Lamer, Burbank, CA (US) 91506; Janette Troncoso, 701 N. Lamer, Burbank, CA (US) 91506

( * ) Notice: Subject to any disclaimer, the term of this patent is extended or adjusted under 35 U.S.C. 154(b) by 1018 days.

(21) Appl. No.: 10/780,308

(22) Filed: Feb. 18, 2004

(51) Int. Cl.
*B65D 30/08* (2006.01)
*B65D 65/02* (2006.01)
*B65D 65/38* (2006.01)

(52) U.S. Cl. ..... 383/110; 150/154; 150/901; 229/87.18

(58) Field of Classification Search ..... 383/4, 383/110; 229/87.18; 150/154, 901
See application file for complete search history.

(56) References Cited

U.S. PATENT DOCUMENTS 664,835 A * 1/1901 Czarniecki ..... 229/125.38
1,971,395 A * 8/1934 Danner ..... 383/99
2,087,966 A * 7/1937 Clark ..... 62/457.1
3,262,283 A 7/1966 Taylor
4,489,815 A * 12/1984 Martinez et al. ..... 190/1
4,509,645 A 4/1985 Hotta
D287,921 S 1/1987 Skamser
4,679,242 A * 7/1987 Brockhaus ..... 383/4
4,984,906 A 1/1991 Little
5,477,965 A * 12/1995 Herbeck ..... 206/424
5,582,028 A 12/1996 Rilling et al.
5,590,781 A * 1/1997 Shackelford et al. ..... 206/521
5,857,778 A * 1/1999 Ells ..... 383/5
5,904,230 A * 5/1999 Peterson ..... 190/107
6,027,249 A 2/2000 Bielinski
6,048,099 A * 4/2000 Muffett et al. ..... 383/20
6,074,093 A * 6/2000 Anderson ..... 383/4
6,164,526 A 12/2000 Dalvey

* cited by examiner

*Primary Examiner*—Jes F. Pascua

(57) ABSTRACT

A thermally insulative device and an associated method of using the device for use in temporarily enshrouding a box are disclosed. The device includes the interconnected elements of a one-piece composite jacket, a plurality of primary coupling strips, a plurality of complementary coupling strips, a plurality of straps, and a buckle. The jacket includes a plurality of panels integrally formed together with a plurality of flaps. The method includes the steps of buckling, carrying, contacting, disconnecting, folding, getting, laying, lifting, lowering, obtaining, placing, tying, unbuckling, unwrapping, and wrapping.

20 Claims, 3 Drawing Sheets

THERMAL INSULATIVE DEVICE AND METHOD

FIELD OF THE INVENTION

The present invention relates to cooler devices, more particularly, to a thermally insulative device and an associated method of using the device as a means for enshrouding a box containing chilled beverage cans to thermally insulate the chilled beverage cans while conveniently transporting the enshrouded box to a desired location, such as a party.

DESCRIPTION OF THE PRIOR ART

The use of coolers and ice chests and similar containers of known designs and configuration is known in the prior art. More specifically, coolers and ice chests and similar containers of known designs and configuration heretofore devised and utilized for the purpose of increasing the efficiency of coolers and ice chests through known methods and apparatuses are known to consist basically of familiar, expected, and obvious structural configurations, notwithstanding the myriad of designs encompassed by the crowded prior art which has been developed for the fulfillment of countless objectives and requirements.

A wide variety of thermally insulative devices is currently available on the commercial market and an even larger number of these types of devices are known in the art of thermally insulative devices, for example, the refrigerating jacket disclosed by Taylor in U.S. Pat. No. 3,262,283; the portable constant temperature box disclosed by Hotta in U.S. Pat. No. 4,509,645; the multi-purpose utility tote disclosed by Little in U.S. Pat. No. 4,984,906; the foldable adjustable cooling pack disclosed by Rilling et al. in U.S. Pat. No. 5,582,028; the ice cooler jacket disclosed by Bielinski in U.S. Pat. No. 6,027,249; the paper-based cooler disclosed by Dalvey in U.S. Pat. No. 6,164,526; and the thermally insulated food bag disclosed by Skamser in U.S. Pat. No. D287,921.

While all of the above-described devices fulfill their respective, particular objectives and requirements, the aforementioned patents do not describe a thermal insulative device having the interconnected elements of a one-piece composite jacket, a plurality of primary coupling strips, a plurality of complementary coupling strips, a plurality of straps, and a buckle, in which the jacket includes a plurality of panels integrally formed together with a plurality of flaps. This combination of elements would specifically match the user's particular individual needs of making it possible to use the device as a means for enshrouding a box containing chilled beverage cans to thermally insulate the chilled beverage cans while conveniently transporting the enshrouded box to a desired location, such as a party. The above-described patents make no provision for a thermal insulative device having the interconnected elements of a one-piece composite jacket, a plurality of primary coupling strips, a plurality of complementary coupling strips, a plurality of straps, and a buckle, in which the jacket includes a plurality of panels integrally formed together with a plurality of flaps.

Therefore, a need exists for a new and improved thermal insulative device having the interconnected elements of a one-piece composite jacket, a plurality of primary coupling strips, a plurality of complementary coupling strips, a plurality of straps, and a buckle, in which the jacket includes a plurality of panels integrally formed together with a plurality of flaps. In this respect, the thermal insulative device according to the present invention substantially departs from the conventional concepts and designs of the prior art, and in doing so provides an apparatus primarily developed for the purpose of providing a means for enshrouding a box containing chilled beverage cans to thermally insulate the chilled beverage cans while conveniently transporting the enshrouded box to a desired location, such as a party.

SUMMARY OF THE INVENTION

The present device and method of using, according to the principles of the present invention, overcomes the shortcomings of the prior art by providing a novel and nonobvious thermal insulative device and method of using the same. The device includes the interconnected elements of a one-piece composite jacket, a plurality of primary coupling strips, a plurality of complementary coupling strips, a plurality of straps, and a buckle. The jacket includes a plurality of panels integrally formed together with a plurality of flaps. The method includes the steps of buckling, carrying, contacting, disconnecting, folding, getting, laying, lifting, lowering, obtaining, placing, tying, unbuckling, unwrapping, and wrapping.

In view of the foregoing disadvantages inherent in the known type thermally insulative devices now present in the prior art, the present invention provides an improved thermal insulative device, which will be described subsequently in great detail, is to provide a new and improved thermal insulative device which is not anticipated, rendered obvious, suggested, or even implied by the prior art, either alone or in any combination thereof.

To attain this, the present invention essentially comprises the interconnected elements of a one-piece composite jacket, a plurality of primary coupling strips, a plurality of complementary coupling strips, a plurality of straps, and a buckle. The jacket includes a plurality of panels integrally formed together with a plurality of flaps.

There has thus been outlined, rather broadly, the more important features of the invention in order that the detailed description thereof that follows may be better understood, and in order that the present contribution of the art may be better appreciated.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved thermal insulative device that has all the advantages of the prior art thermal insulative device and none of the disadvantages.

It is another object of the present invention to provide a new and improved thermal insulative device that may be easily and efficiently manufactured and marketed.

An even further object of the present invention is to provide a new and improved thermal insulative device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new thermal insulative device that provides in the apparatuses and methods of the prior art some of the advantages thereof, while simultaneously overcoming some of the disadvantages normally associated therewith.

Even still another object of the present invention is to provide a thermal insulative device having the interconnected elements of a one-piece composite jacket, a plurality of primary coupling strips, a plurality of complementary coupling strips, a plurality of straps, and a buckle, in which the jacket includes a plurality of panels integrally formed together with a plurality of flaps. This combination of elements makes it possible to use the device as a means for enshrouding a box containing chilled beverage cans to thermally insulate the chilled beverage cans while conveniently transporting the enshrouded box to a desired location, such as a party.

Lastly, it is an object of the present invention to provide a new and improved method of using comprising the steps of buckling, carrying, contacting, disconnecting, folding, getting, laying, lifting, lowering, obtaining, placing, tying, unbuckling, unwrapping, and wrapping.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
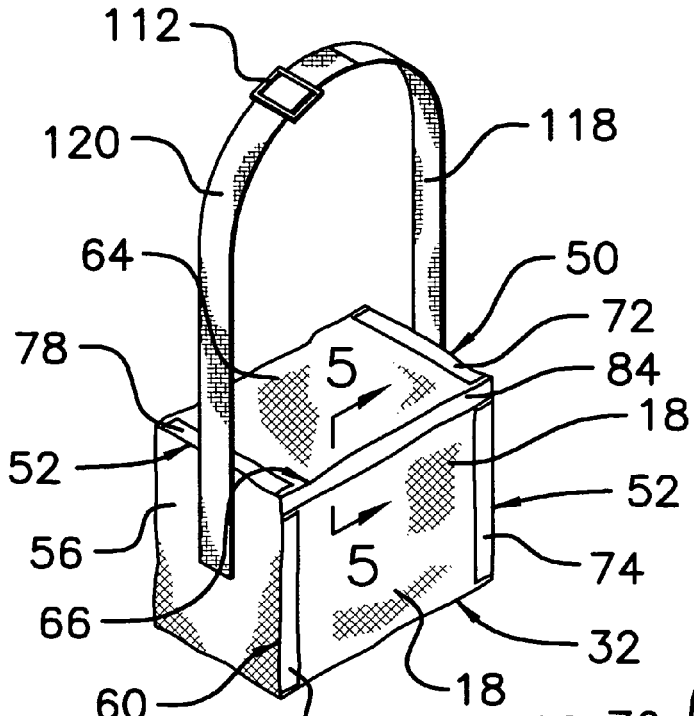
FIG. 1 is a perspective view of an preferred embodiment of the thermal insulative device constructed in accordance with the principles of the present invention.

Referring now to the drawings, and in particular FIGS. 1 to 5 thereof, one preferred embodiment of the present invention is shown and generally designated by the reference numeral 10. One preferred embodiment of a thermally insulative device 10 which is foldable into a three dimensional box-like shroud for encasing a box having a box height, a box width and a box length, the device 10 comprises: a one-piece composite jacket 14, a plurality of primary coupling strips, a plurality of complementary coupling strips, a plurality of straps, and a buckle 122. The a one-piece composite jacket 14 formed with an interior flexible fabric 16, an exterior flexible fabric 18 and with a thermal insulation material 20 therebetween. The jacket 14 comprising a plurality of panels integrally formed together with a plurality of flaps. The plurality of panels includes: a central rectangular bottom panel 22, a generally rectangular front panel 32, a generally rectangular back panel 40, a generally rectangular left side panel 48, a generally rectangular right side panel 56, and a generally rectangular top panel 64. The central rectangular bottom panel 22 has a first long border 24, a second long border 26, a first short border 28 and a second short border 30. The first long border 24 of the central rectangular bottom panel 22 is sized to be slightly longer than the box length. The second long border 26 of the central rectangular bottom panel 22 is sized to be slightly longer than the box length. The first short border 28 of the central rectangular bottom panel 22 sized to be slightly longer than the box width. The second short border 30 of the central rectangular bottom panel 22 sized to be slightly longer than the box width. The generally rectangular front panel 32 integrally formed with the first long border 24 of the bottom panel 22, the front panel 32 also having a first edge 34, a second edge 36 and a third edge 38. The first edge 34 of the front panel 32 is sized slightly longer than the box length. The second edge 36 of the front panel 32 sized slightly longer than the box height. The third edge 38 of the front panel 32 sized slightly longer than the box height. The generally rectangular back panel 40 integrally formed with the second long border 26 of the bottom panel 22. The back panel 40 also having a fifth border 42, a fourth edge 44, and a fifth edge 46. The fifth border 42 of the back panel 40 sized slightly longer than the box length. The fourth edge 44 of the back panel 40 sized slightly longer than the box height. The fifth edge 46 of the back panel 40 sized slightly longer than the box height. The generally rectangular left side panel 48 integrally formed with the first short border 28 of the bottom panel 22. The left side panel 48 also having a first margin 50, a second margin 52, and a third margin 54. The first margin 50 of the left side panel 48 sized slightly longer than the box width. The second margin 52 of the left side panel 48 sized slightly longer than the box height, and the third margin 54 of the left side panel 48 sized slightly longer than the box height. The generally rectangular right side panel 56 integrally formed with the second short border 30 of the bottom panel 22. The right side panel 56 also having a fourth margin 58, a fifth margin 60, and sixth margin 62. The fourth margin 58 of the right side panel 56 sized slightly longer than the box width. The fifth margin 60 of the right side panel 56 sized slightly longer than the box height. The sixth margin 62 of the right side panel 56 sized slightly longer than the box height. The generally rectangular top panel 64 integrally formed with the long fifth border 42 of the back panel 40. The top panel 64 also having a seventh margin 66, a sixth edge 68, and a seventh edge 70. The seventh margin 66 of the top panel 64 sized slightly longer than the box length. The sixth edge 68 of the top panel 64 sized slightly longer than the box width. The seventh edge 70 of the top panel 64 sized slightly longer than the box width. The plurality of flaps includes a first flap 72, a second flap 74, a third flap 76, a fourth flap 78, a fifth flap 80, a sixth flap 82, and a seventh flap 84. The first flap 72 integrally formed with the first margin 50 of the left side panel 48. The second flap 74 integrally formed with the second margin 52 of the left side panel 48. The third flap 76 integrally formed with the third margin 54 of the left side panel 48. The fourth flap 78 integrally formed with the fourth margin 58 of the right side panel 56. The fifth flap 80 integrally formed with the fifth margin 60 of the right side panel 56. The sixth flap 82 integrally formed with the sixth margin 62 of the right side panel 56. The seventh flap 84 integrally formed with the seventh margin 66 of the top panel 64. The plurality of primary coupling strips attached to the plurality of flaps, wherein each primary coupling strip having a plurality of miniature hooks 100. The plurality of primary coupling strips including: a first primary coupling strip 86 attached to the first edge 34 of the front panel 32; a second primary coupling strip 88 attached to the second edge 36 of the front panel 32; a third primary coupling strip 90 attached to the third edge 38 of the front panel 32; a fourth primary coupling strip 92 attached to the fourth edge 44 of the back panel 40; a fifth primary coupling strip 94 attached to the fifth edge 46 of the back panel 40; a sixth primary coupling strip 96 attached to the sixth edge 68 of the top panel 64; and a seventh primary coupling strip 98 attached to the seventh edge 70 of the top panel 64. The plurality of complementary coupling strips attached to the jacket 14, each complementary coupling strip having a plurality of miniature loops 116, wherein when the plurality of miniature hooks 100 of anyone of the primary coupling strips is placed in contact with the plurality of miniature loops 116 of anyone of the complementary coupling strips then a portion of the plurality of miniature hooks 100 become entangled with a portion of the miniature loops 116. The plurality of complementary coupling strips including: a first complementary coupling strip 102 attached to the first margin 50 of the left side panel 48; a second complementary coupling strip 104 attached to the second margin 52 of the left side panel 48; a third complementary coupling strip 106 attached to the third margin 54 of the left side panel 48; a fourth complementary coupling strip 108 attached to the fourth margin 58 of the left side panel 48; a fifth complementary coupling strip 110 attached to the fifth margin 60 of the left side panel 48; a sixth complementary coupling strip 112 attached to the sixth margin 62 of the left side panel 48; and a seventh complementary coupling strip 114 attached to the seventh margin 66 of the left side panel 48. The plurality of straps is attached to the jacket 14, wherein the plurality of straps comprises: a left strap 118 attached to the left side panel 48; and a right strap 120 attached to the right side panel 56. The buckle 122 attached to one of the straps of the plurality of straps, wherein the buckle 122 is attachable to the other strap of the plurality of straps.

The buckle 122 may either be attached to the right strap 120 or attached to the left strap 118.

The interior flexible fabric 16 may either comprises canvas or a plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The exterior flexible fabric 18 may either comprises canvas or plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The thermal insulation material 20 comprises a plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The box 12 may be any commercially available box 12. One preferred configuration of the box 12 is that it is capable of containing twelve beer cans 124, wherein the box height is about twelve and one half inches, the box length is about ten and one half inches, and the box width of about seven and one half inches. Another preferred configuration of the box 12 is that it is capable of containing twenty four beer cans 124, wherein the box height is about nine and three fourths inches, the box length is about ten and one half inches, and the box width of about eight inches.

Another preferred embodiment of the device 10 comprises a one-piece composite jacket 14, a plurality of primary coupling strips, a plurality of complementary coupling strips, a plurality of straps, and a buckle 122. The one-piece composite jacket 14 formed with an interior flexible fabric 16, an exterior flexible fabric 18 and with a thermal insulation material 20 therebetween. The jacket 14 comprising a plurality of panels integrally formed together with a plurality of flaps. The plurality of panels includes: a central rectangular bottom panel 22, a generally rectangular front panel 32, a generally rectangular back panel 40, a generally rectangular left side panel 48, a generally rectangular right side panel 56, and a generally rectangular top panel 64. The central rectangular bottom panel 22 has a first long border 24, a second long border 26, a first short border 28 and a second short border 30. The first long border 24 of the central rectangular bottom panel 22 is sized to be slightly longer than the box length. The second long border 26 of the central rectangular bottom panel 22 is sized to be slightly longer than the box length. The first short border 28 of the central rectangular bottom panel 22 sized to be slightly longer than the box width. The second short border 30 of the central rectangular bottom panel 22 sized to be slightly longer than the box width. The generally rectangular front panel 32 integrally formed with the first long border 24 of the bottom panel 22, the front panel 32 also having a first edge 34, a second edge 36 and a third edge 38. The first edge 34 of the front panel 32 is sized slightly longer than the box length. The second edge 36 of the front panel 32 sized slightly longer than the box height. The third edge 38 of the front panel 32 sized slightly longer than the box height. The generally rectangular back panel 40 integrally formed with the second long border 26 of the bottom panel 22. The back panel 40 also having a fifth border 42, a fourth edge 44, and a fifth edge 46. The fifth border 42 of the back panel 40 sized slightly longer than the box length. The fourth edge 44 of the back panel 40 sized slightly longer than the box height. The fifth edge 46 of the back panel 40 sized slightly longer than the box height. The generally rectangular left side panel 48 integrally formed with the first short border 28 of the bottom panel 22. The left side panel 48 also having a first margin 50, a second margin 52, and a third margin 54. The first margin 50 of the left side panel 48 sized slightly longer than the box width. The second margin 52 of the left side panel 48 sized slightly longer than the box height, and the third margin 54 of the left side panel 48 sized slightly longer than the box height. The generally rectangular right side panel 56 integrally formed with the second short border 30 of the bottom panel 22. The right side panel 56 also having a fourth margin 58, a fifth margin 60, and sixth margin 62. The fourth margin 58 of the right side panel 56 sized slightly longer than the box width. The fifth margin 60 of the right side panel 56 sized slightly longer than the box height. The sixth margin 62 of the right side panel 56 sized slightly longer than the box height. The generally rectangular top panel 64 integrally formed with the long fifth border 42 of the back panel 40. The top panel 64 also having a seventh margin 66, a sixth edge 68, and a seventh edge 70. The seventh margin 66 of the top panel 64 sized slightly longer than the box length. The sixth edge 68 of the top panel 64 sized slightly longer than the box width. The seventh edge 70 of the top panel 64 sized slightly longer than the box width. The plurality of flaps includes a first flap 72, a second flap 74, a third flap 76, a fourth flap 78, a fifth flap 80, a sixth flap 82, and a seventh flap 84. The first flap 72 integrally formed with the first margin 50 of the left side panel 48. The second flap 74 integrally formed with the second margin 52 of the left side panel 48. The third flap 76 integrally formed with the third margin 54 of the left side panel 48. The fourth flap 78 integrally formed with the fourth margin 58 of the right side panel 56. The fifth flap 80 integrally formed with the fifth margin 60 of the right side panel 56. The sixth flap 82 integrally formed with the sixth margin 62 of the right side panel 56. The seventh flap 84 integrally formed with the seventh margin 66 of the top panel 64. The plurality of primary coupling strips attached to the plurality of flaps, wherein each primary coupling strip having a plurality of miniature loops 106. The plurality of primary coupling strips including: a first primary coupling strip 86 attached to the first edge 34 of the front panel 32; a second primary coupling strip 88 attached to the second edge 36 of the front panel 32; a third primary coupling strip 90 attached to the third edge 38 of the front panel 32; a fourth primary coupling strip 92 attached to the fourth edge 44 of the back panel 40; a fifth primary coupling strip 94 attached to the fifth edge 46 of the back panel 40; a sixth primary coupling strip 96 attached to the sixth edge 68 of the top panel 64; and a seventh primary coupling strip 98 attached to the seventh edge 70 of the top panel 64. The plurality of complementary coupling strips attached to the jacket 14, each complementary coupling strip having a plurality of miniature hooks 100, wherein when the plurality of miniature loops 106 of anyone of the primary coupling strips is placed in contact with the plurality of miniature hooks 100 of anyone of the complementary coupling strips then a portion of the plurality of miniature loops 106 become entangled with a portion of the miniature hooks 100. The plurality of complementary coupling strips including: a first complementary coupling strip 102 attached to the first margin 50 of the left side panel 48; a second complementary coupling strip 104 attached to the second margin 52 of the left side panel 48; a third complementary coupling strip 106 attached to the third margin 54 of the left side panel 48; a fourth complementary coupling strip 108 attached to the fourth margin 58 of the left side panel 48; a fifth complementary coupling strip 110 attached to the fifth margin 60 of the left side panel 48; a sixth complementary coupling strip 112 attached to the sixth margin 62 of the left side panel 48; and a seventh complementary coupling strip 114 attached to the seventh margin 66 of the left side panel 48. The plurality of straps is attached to the jacket 14, wherein the plurality of straps comprises: a left strap 118 attached to the left side panel 48; and a right strap 120 attached to the right side panel 56. The buckle 122 attached to one of the straps of the plurality of straps, wherein the buckle 122 is attachable to the other strap of the plurality of straps.

One preferred embodiment of a method of using a thermally insulative device 10 which is foldable into a three dimensional box-like shroud for encasing a box having a box height, a box width and a box length, the method comprises the steps of buckling, carrying, contacting, disconnecting, folding, getting, laying, lifting, lowering, obtaining, placing, tying, unbuckling, unwrapping, and wrapping. The obtaining step comprises obtaining the device 10 comprising: a one-piece composite jacket 14 formed with an interior flexible fabric 16, an exterior flexible fabric 18 and with a thermal insulation material 20 therebetween, the jacket 14 comprising a plurality of panels integrally formed together with a plurality of flaps, wherein the plurality of panels including: a central rectangular bottom panel 22 with a first long border 24, a second long border 26, a first short border 28 and a second short border 30, the first long border 24 of the central rectangular bottom panel 22 is sized to be slightly longer than the box length, the second long border 26 of the central rectangular bottom panel 22 is sized to be slightly longer than the box length, the first short border 28 of the central rectangular bottom panel 22 sized to be slightly longer than the box width, the second short border 30 of the central rectangular bottom panel 22 sized to be slightly longer than the box width; a generally rectangular front panel 32 integrally formed with the first long border 24 of the bottom panel 22, the front panel 32 also having a first edge 34, a second edge 36 and a third edge 38, the first edge 34 of the front panel 32 is sized slightly longer than the box length, the second edge 36 of the front panel 32 sized slightly longer than the box height, the third edge 38 of the front panel 32 sized slightly longer than the box height; a generally rectangular back panel 40 integrally formed with the second long border 26 of the bottom panel 22, the back panel 40 also having a fifth border 42, a fourth edge 44, and a fifth edge 46, the fifth border 42 of the back panel 40 sized slightly longer than the box length, the fourth edge 44 of the back panel 40 sized slightly longer than the box height, the fifth edge 46 of the back panel 40 sized slightly longer than the box height; a generally rectangular left side panel 48 integrally formed with the first short border 28 of the bottom panel 22, the left side panel 48 also having a first margin 50, a second margin 52, and a third margin 54, the first margin 50 of the left side panel 48 sized slightly longer than the box width, the second margin 52 of the left side panel 48 sized slightly longer than the box height, and the third margin 54 of the left side panel 48 sized slightly longer than the box height; a generally rectangular right side panel 56 integrally formed with the second short border 30 of the bottom panel 22, the right side panel 56 also having a fourth margin 58, a fifth margin 60, and sixth margin 62, the fourth margin 58 of the right side panel 56 sized slightly longer than the box width, the fifth margin 60 of the right side panel 56 sized slightly longer than the box height, the sixth margin 62 of the right side panel 56 sized slightly longer than the box height; and a generally rectangular top panel 64 integrally formed with the long fifth border 42 of the back panel 40, the top panel 64 also having a seventh margin 66, a sixth edge 68, and a seventh edge 70, the seventh margin 66 of the top panel 64 sized slightly longer than the box length, the sixth edge 68 of the top panel 64 sized slightly longer than the box width, the seventh edge 70 of the top panel 64 sized slightly longer than the box width; and wherein the plurality of flaps including: a first flap 72 integrally formed with the first margin 50 of the left side panel 48; a second flap 74 integrally formed with the second margin 52 of the left side panel 48; a third flap 76 integrally formed with the third margin 54 of the left side panel 48; a fourth flap 78 integrally formed with the fourth margin 58 of the right side panel 56; a fifth flap 80 integrally formed with the fifth margin 60 of the right side panel 56; a sixth flap 82 integrally formed with the sixth margin 62 of the right side panel 56; and a seventh flap 84 integrally formed with the seventh margin 66 of the top panel 64; a plurality of primary coupling strips attached to the plurality of flaps, wherein each primary coupling strip having a plurality of miniature hooks 100, the plurality of primary coupling strips including: a first primary coupling strip 86 attached to the first edge 34 of the front panel 32; a second primary coupling strip 88 attached to the second edge 36 of the front panel 32; a third primary coupling strip 90 attached to the third edge 38 of the front panel 32; a fourth primary coupling strip 92 attached to the fourth edge 44 of the back panel 40; a fifth primary coupling strip 94 attached to the fifth edge 46 of the back panel 40; a sixth primary coupling strip 96 attached to the sixth edge 68 of the top panel 64; and a seventh primary coupling strip 98 attached to the seventh edge 70 of the top panel 64; a plurality of complementary coupling strips attached to the jacket 14, each complementary coupling strip having a plurality of miniature loops 116, wherein when the plurality of miniature hooks 100 of anyone of the primary coupling strips is placed in contact with the plurality of miniature loops 116 of anyone of the complementary coupling strips then a portion of the plurality of miniature hooks 100 become entangled with a portion of the miniature loops 116, wherein the plurality of complementary coupling strips including: a first complementary coupling strip 102 attached to the first margin 50 of the left side panel 48; a second complementary coupling strip 104 attached to the second margin 52 of the left side panel 48; a third complementary coupling strip 106 attached to the third margin 54 of the left side panel 48; a fourth complementary coupling strip 108 attached to the fourth margin 58 of the left side panel 48; a fifth complementary coupling strip 110 attached to the fifth margin 60 of the left side panel 48; a sixth complementary coupling strip 112 attached to the sixth margin 62 of the left side panel 48; and a seventh complementary coupling strip 114 attached to the seventh margin 66 of the left side panel 48; a plurality of straps attached to the jacket 14, wherein the plurality of straps comprising: a left strap 118 attached to the left side panel 48; and a right strap 120 attached to the right side panel 56; and a buckle 122 attached to one of the straps of the plurality of straps, wherein the buckle 122 is attachable to the other strap of the plurality of straps. The laying step comprises laying out the device 10 onto a flat table top so that the device 10 is substantially flat. The getting step comprises getting the box 12. The placing step comprises placing the box 12 onto the bottom panel 22 of the flattened device 10. The wrapping step comprises wrapping the jacket 14 around the box 12 to enshroud the jacket 14 around the box 12. The contacting step comprises contacting the primary coupling strips with the complementary coupling strips of the device 10 when the jacket 14 is wrapped around the box 12 locked the jacket 14 around the box 12. The buckling step comprises buckling up the buckle 122 to the other strap of the plurality of straps when the jacket 14 is locked around the box 12. The carrying step comprises carrying the device 10 from one location to another location when the jacket 14 is locked around the box 12 and the buckle 122 is buckled up to the other strap. The lowering step comprises lowering the device 10 down onto a flat surface, the lowering step performed subsequent to the carrying step. The unbuckling step comprises unbuckling the buckled up buckle 122 from the other strap of the plurality of straps when the jacket 14 is locked around the box 12 and when the device 10 is lowered onto the flat surface. The disconnecting step comprises disconnecting the contacted primary coupling strips from the complementary coupling strips of the device 10 when the jacket 14 is wrapped around the box 12 and when the device 10 is lowered onto the flat surface. The unwrapping step comprises unwrapping the jacket 14 from around the box 12 when the primary coupling strips of the device 10 are disconnected from the complementary coupling strips of the device 10, the unwrapping step performed subsequent to the disconnecting step. The lifting step comprises lifting up the box 12, the lifting step performed subsequent to the unwrapping step. The folding step comprises folding up the device 10, the folding step performed subsequent to the lifting step. The tying step comprises tying the straps around the folded up device 10.

Another preferred embodiment of the method consists essentially of the steps of buckling, carrying, contacting, disconnecting, folding, getting, laying, lifting, lowering, obtaining, placing, tying, unbuckling, unwrapping, and wrapping.

Referring now to FIG. 1 which depicts a perspective view of an preferred embodiment of the thermal insulative device 10 folded into a three dimensional box-like shroud.

Figure 2:
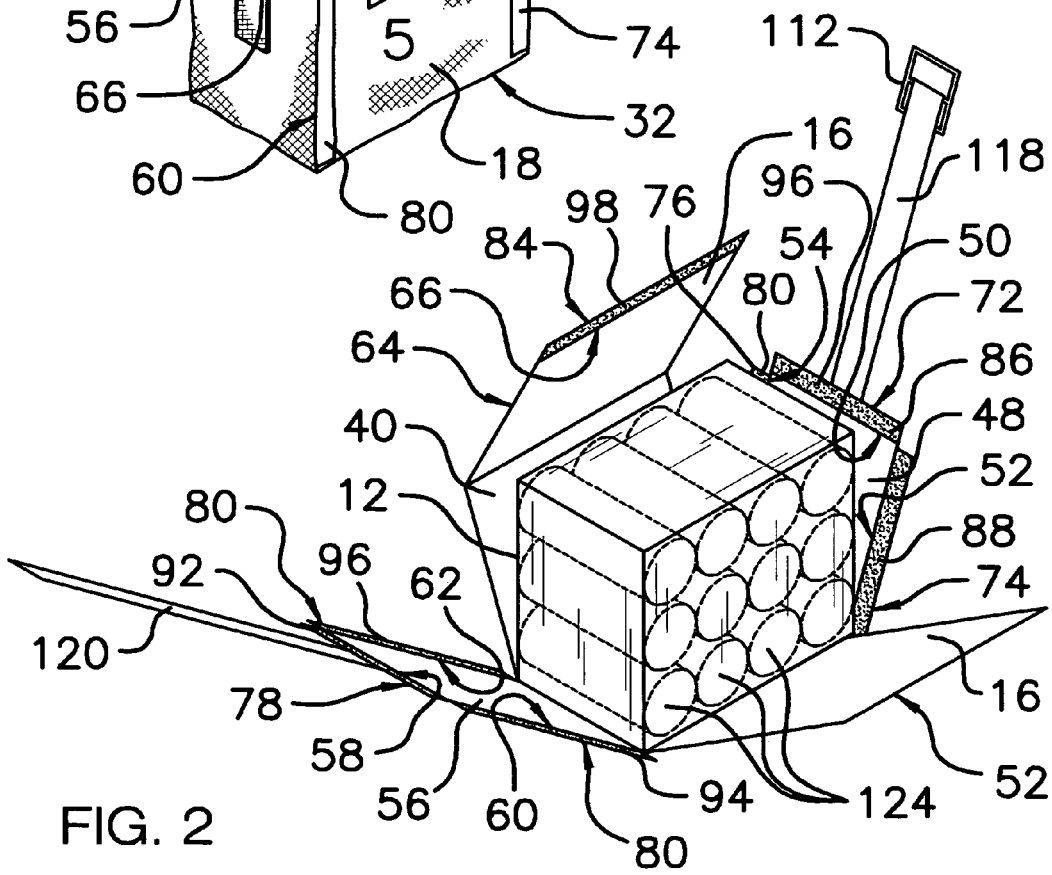
FIG. 2 is a perspective view of a preferred embodiment of the thermal insulative device of the present invention.

Referring now to FIG. 2 which depicts a perspective view of a preferred embodiment of the thermal insulative device 10 partially wrapped around a box 12 containing a plurality of cans 124.

Figure 3:
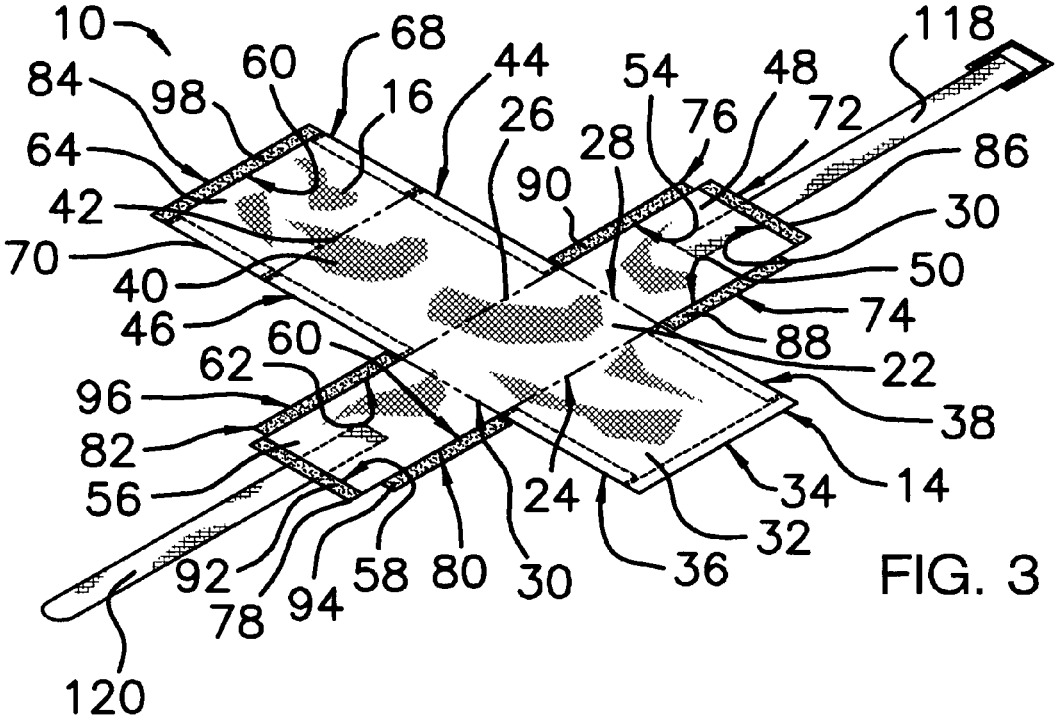
FIG. 3 is a perspective view of a preferred embodiment of the thermal insulative device of the present invention.

Referring now to FIG. 3 which depicts a perspective view of a preferred embodiment of the thermal insulative device 10 showing the device 10 flattened with the interior flexible fabric 16 exposed.

Figure 4:
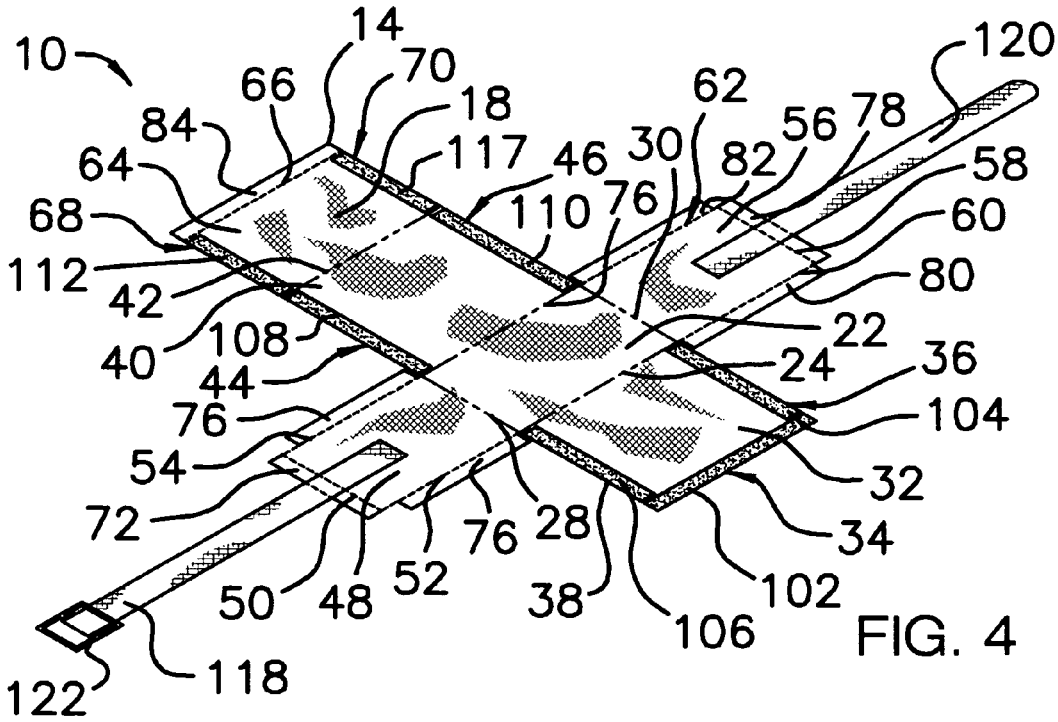
FIG. 4 is a perspective view of a preferred embodiment of the thermal insulative device of the present invention.

Referring now to FIG. 4 which depicts a perspective view of a preferred embodiment of the thermal insulative device 10 showing the device 10 flattened with the exterior flexible fabric exposed.

Figure 5:
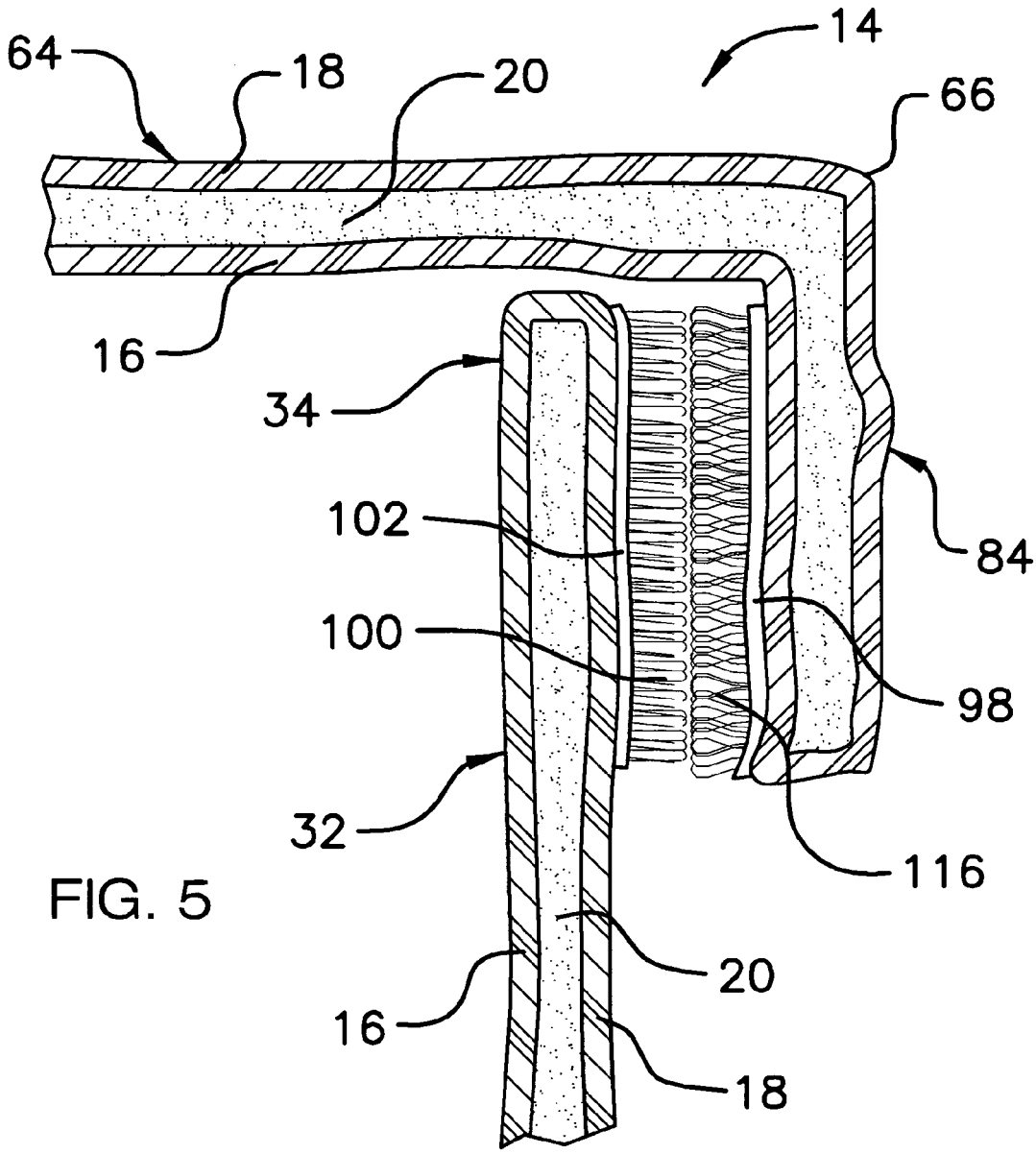
FIG. 5 is a cross sectional side view of a portion of a preferred embodiment of the thermal insulative device of the present invention.

Referring now to FIG. 5 which depicts a cross sectional side view of a portion of a preferred embodiment of the thermal insulative device 10 showing the jacket 14 formed with an interior flexible fabric 16, an exterior flexible fabric 18 and with a thermal insulation material 20 therebetween. Also shown is the seventh flap 84 of the top panel 64 reversibly attachable to the first edge 34 of the front panel 32 by interlocking together the miniature hooks 100 of the first complementary coupling strip 102 with the miniature loops 116 of the seventh primary coupling strip.

As to the manner of usage and operation of the present invention, the same should be apparent from the above description. Accordingly, no further discussion relating to the manner of usage and operation will be provided.

While a preferred embodiment of the thermal insulative device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A thermally insulative device which is foldable into a three dimensional box-like shroud for encasing a box having a box height, a box width and a box length, said device comprising:

a one-piece composite jacket formed with an interior flexible fabric, an exterior flexible fabric and with a thermal insulation material therebetween, said jacket comprising a plurality of panels integrally formed together with a plurality of flaps, wherein said plurality of panels including:

a central rectangular bottom panel having a first long border, a second long border, a first short border and a second short border, said first long border of said central rectangular bottom panel is sized to be slightly longer than the box length, said second long border of said central rectangular bottom panel is sized to be slightly longer than the box length, said first short border of said central rectangular bottom panel sized to be slightly longer than the box width, said second short border of said central rectangular bottom panel sized to be slightly longer than the box width;

a generally rectangular front panel integrally formed with said first long border of said bottom panel, said front panel also having a first edge, a second edge and a third edge, said first edge of said front panel is sized slightly longer than the box length, said second edge of said front panel sized slightly longer than the box height, said third edge of said front panel sized slightly longer than the box height, a generally rectangular back panel integrally formed with said second long border of said bottom panel, said back panel also having a fifth border, a fourth edge, and a fifth edge, said fifth border of said back panel sized slightly longer than the box length, said fourth edge of said back panel sized slightly longer than the box height, said fifth edge of said back panel sized slightly longer than the box height;

a generally rectangular left side panel integrally formed with said first short border of said bottom panel, said left side panel also having a first margin, a second margin, and a third margin, said first margin of said left side panel sized slightly longer than the box width, said second margin of said left side panel sized slightly longer than the box height, and said third margin of said left side panel sized slightly longer than the box height;

a generally rectangular right side panel integrally formed with said second short border of said bottom panel, said right side panel also having a fourth margin, a fifth margin, and sixth margin, said fourth margin of said right side panel sized slightly longer than the box width, said fifth margin of said right side panel sized slightly longer than the box height, said sixth margin of said right side panel sized slightly longer than the box height; and a generally rectangular top panel integrally formed with said long fifth border of said back panel, said top panel also having a seventh margin, a sixth edge, and a seventh edge, said seventh margin of said top panel sized slightly longer than the box length, said sixth edge of said top panel sized slightly longer than the box width, said seventh edge of said top panel sized slightly longer than the box width; and wherein said plurality of flaps including:

a first flap integrally formed with said first margin of said left side panel;

a second flap integrally formed with said second margin of said left side panel;

a third flap integrally formed with said third margin of said left side panel;

a fourth flap integrally formed with said fourth margin of said right side panel;

a fifth flap integrally formed with said fifth margin of said right side panel;

a sixth flap integrally formed with said sixth margin of said right side panel; and a seventh flap integrally formed with said seventh margin of said top panel;

a plurality of primary coupling strips attached to said plurality of flaps, wherein each primary coupling strip having a plurality of miniature hooks, said plurality of primary coupling strips including:

a first primary coupling strip attached to said first edge of said front panel;

a second primary coupling strip attached to said second edge of said front panel;

a third primary coupling strip attached to said third edge of said front panel;

a fourth primary coupling strip attached to said fourth edge of said back panel;

a fifth primary coupling strip attached to said fifth edge of said back panel;

a sixth primary coupling strip attached to said sixth edge of said top panel; and a seventh primary coupling strip attached to said seventh edge of said top panel;

a plurality of complementary coupling strips attached to said jacket, each complementary coupling strip having a plurality of miniature loops, wherein when said plurality of miniature hooks of anyone of said primary coupling strips is placed in contact with said plurality of miniature loops of anyone of said complementary coupling strips then a portion of said plurality of miniature hooks become entangled with a portion of said miniature loops, wherein said plurality of complementary coupling strips including:

a first complementary coupling strip attached to said first margin of said left side panel;

a second complementary coupling strip attached to said second margin of said left side panel;

a third complementary coupling strip attached to said third margin of said left side panel;

a fourth complementary coupling strip attached to said fourth margin of said left side panel;

a fifth complementary coupling strip attached to said fifth margin of said left side panel;

a sixth complementary coupling strip attached to said sixth margin of said left side panel; and a seventh complementary coupling strip attached to said seventh margin of said left side panel;

a plurality of straps attached to said jacket, wherein said plurality of straps comprising:

a left strap attached to said left side panel; and a right strap attached to said right side panel; and a buckle attached to one of the straps of said plurality of straps, wherein said buckle is attachable to the other strap of said plurality of straps.

2. The device of claim 1 wherein said buckle is attached to said right strap.

3. The device of claim 1 wherein said buckle is attached to said left strap.

4. The device of claim 1 wherein said interior flexible fabric comprises canvas.

5. The device of claim 1 wherein said interior flexible fabric comprises plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

6. The device of claim 1 wherein said exterior flexible fabric comprises canvas.

7. The device of claim 1 wherein said exterior flexible fabric comprises plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

8. The device of claim 1 wherein said thermal insulation material is a plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

9. The device of claim 1 wherein the box is capable of containing twelve beer cans, in which the box height is about twelve and one half inches, the box length is about ten and one half inches, and the box width of about seven and one half inches.

10. The device of claim 1 wherein the box is capable of containing twenty four beer cans, wherein the box height is about nine and three fourths inches, the box length is about ten and one half inches, and the box width of about eight inches.

11. A thermally insulative device which is foldable into a three dimensional box-like shroud for encasing a box having a box height, a box width and a box length, said device comprising:

a one-piece composite jacket formed with an interior flexible fabric, an exterior flexible fabric and with a thermal insulation material therebetween, said jacket comprising a plurality of panels integrally formed together with a plurality of flaps, wherein said plurality of panels including:

a central rectangular bottom panel having a first long border, a second long border, a first short border and a second short border, said first long border of said central rectangular bottom panel is sized to be slightly longer than the box length, said second long border of said central rectangular bottom panel is sized to be slightly longer than the box length, said first short border of said central rectangular bottom panel sized to be slightly longer than the box width, said second short border of said central rectangular bottom panel sized to be slightly longer than the box width;

a generally rectangular front panel integrally formed with said first long border of said bottom panel, said front panel also having a first edge, a second edge and a third edge, said first edge of said front panel is sized slightly longer than the box length, said second edge of said front panel sized slightly longer than the box height, said third edge of said front panel sized slightly longer than the box height;

a generally rectangular back panel integrally formed with said second long border of said bottom panel, said back panel also having a fifth border, a fourth edge, and a fifth edge, said fifth border of said back panel sized slightly longer than the box length, said fourth edge of said back panel sized slightly longer than the box height, said fifth edge of said back panel sized slightly longer than the box height;

a generally rectangular left side panel integrally formed with said first short border of said bottom panel, said left side panel also having a first margin, a second margin, and a third margin, said first margin of said left side panel sized slightly longer than the box width, said second margin of said left side panel sized slightly longer than the box height, and said third margin of said left side panel sized slightly longer than the box height;

a generally rectangular right side panel integrally formed with said second short border of said bottom panel, said right side panel also having a fourth margin, a fifth margin, and sixth margin, said fourth margin of said right side panel sized slightly longer than the box width, said fifth margin of said right side panel sized slightly longer than the box height, said sixth margin of said right side panel sized slightly longer than the box height; and a generally rectangular top panel integrally formed with said long fifth border of said back panel, said top panel also having a seventh margin, a sixth edge, and a seventh edge, said seventh margin of said top panel sized slightly longer than the box length, said sixth edge of said top panel sized slightly longer than the box width, said seventh edge of said top panel sized slightly longer than the box width; and wherein said plurality of flaps including:

a first flap integrally formed with said first margin of said left side panel;

a second flap integrally formed with said second margin of said left side panel;

a third flap integrally formed with said third margin of said left side panel;

a fourth flap integrally formed with said fourth margin of said right side panel;

a fifth flap integrally formed with said fifth margin of said right side panel;

a sixth flap integrally formed with said sixth margin of said right side panel; and a seventh flap integrally formed with said seventh margin of said top panel;

a plurality of primary coupling strips attached to said plurality of flaps, wherein each primary coupling strip having a plurality of miniature loops, said plurality of primary coupling strips including:

a first primary coupling strip attached to said first edge of said front panel;

a second primary coupling strip attached to said second edge of said front panel;

a third primary coupling strip attached to said third edge of said front panel;

a fourth primary coupling strip attached to said fourth edge of said back panel;

a fifth primary coupling strip attached to said fifth edge of said back panel;

a sixth primary coupling strip attached to said sixth edge of said top panel; and a seventh primary coupling strip attached to said seventh edge of said top panel;

a plurality of complementary coupling strips attached to said jacket, each complementary coupling strip having a plurality of miniature hooks, wherein when said plurality of miniature loops of anyone of said primary coupling strips is placed in contact with said plurality of miniature hooks of anyone of said complementary coupling strips then a portion of said plurality of miniature loops become entangled with a portion of said miniature hooks, said plurality of complementary coupling strips including:

a first complementary coupling strip attached to said first margin of said left side panel;

a second complementary coupling strip attached to said second margin of said left side panel;

a third complementary coupling strip attached to said third margin of said left side panel;

a fourth complementary coupling strip attached to said fourth margin of said left side panel;

a fifth complementary coupling strip attached to said fifth margin of said left side panel;

a sixth complementary coupling strip attached to said sixth margin of said left side panel; and a seventh complementary coupling strip attached to said seventh margin of said left side panel;

a plurality of straps attached to said jacket, wherein said plurality of straps comprising:

a left strap attached to said left side panel; and a right strap attached to said right side panel; and a buckle attached to one of the straps of said plurality of straps, wherein said buckle is attachable to the other strap of said plurality of straps.

12. The device of claim 11 wherein said buckle is attached to said right strap.

13. The device of claim 11 wherein said buckle is attached to said left strap.

14. The device of claim 11 wherein said interior flexible fabric comprises canvas.

15. The device of claim 11 wherein said interior flexible fabric comprises plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

16. The device of claim 11 wherein said exterior flexible fabric comprises canvas.

17. The device of claim 11 wherein said exterior flexible fabric comprises plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

18. The device of claim 11 wherein said thermal insulation material is a plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

19. The device of claim 11 wherein the box is capable of containing twelve beer cans, wherein said box height is about twelve and one half inches, the box length is about ten and one half inches, and the box width of about seven and one half inches.

20. A method of using a thermally insulative device which is foldable into a three dimensional box-like shroud for encasing a box having a box height, a box width and a box length, said method comprising:

obtaining the device comprising:

a one-piece composite jacket formed with an interior flexible fabric, an exterior flexible fabric and with a thermal insulation material therebetween, the jacket comprising a plurality of panels integrally formed together with a plurality of flaps, wherein the plurality of panels including:

a central rectangular bottom panel having a first long border, a second long border, a first short border and a second short border, the first long border of the central rectangular bottom panel is sized to be slightly longer than the box length, the second long border of the central rectangular bottom panel is sized to be slightly longer than the box length, the first short border of the central rectangular bottom panel sized to be slightly longer than the box width, the second short border of the central rectangular bottom panel sized to be slightly longer than the box width;

a generally rectangular front panel integrally formed with the first long border of the bottom panel, the front panel also having a first edge, a second edge and a third edge, the first edge of the front panel is sized slightly longer than the box length, the second edge of the front panel sized slightly longer than the box height, the third edge of the front panel sized slightly longer than the box height;

a generally rectangular back panel integrally formed with the second long border of the bottom panel, the back panel also having a fifth border, a fourth edge, and a fifth edge, the fifth border of the back panel sized slightly longer than the box length, the fourth edge of the back panel sized slightly longer than the box height, the fifth edge of the back panel sized slightly longer than the box height;

a generally rectangular left side panel integrally formed with the first short border of the bottom panel, the left side panel also having a first margin, a second margin, and a third margin, the first margin of the left side panel sized slightly longer than the box width, the second margin of the left side panel sized slightly longer than the box height, and the third margin of the left side panel sized slightly longer than the box height;

a generally rectangular right side panel integrally formed with the second short border of the bottom panel, the right side panel also having a fourth margin, a fifth margin, and sixth margin, the fourth margin of the right side panel sized slightly longer than the box width, the fifth margin of the right side panel sized slightly longer than the box height, the sixth margin of the right side panel sized slightly longer than the box height; and a generally rectangular top panel integrally formed with the long fifth border of the back panel, the top panel also having a seventh margin, a sixth edge, and a seventh edge, the seventh margin of the top panel sized slightly longer than the box length, the sixth edge of the top panel sized slightly longer than the box width, the seventh edge of the top panel sized slightly longer than the box width; and wherein the plurality of flaps including:

a first flap integrally formed with the first margin of the left side panel;

a second flap integrally formed with the second margin of the left side panel;

a third flap integrally formed with the third margin of the left side panel;

a fourth flap integrally formed with the fourth margin of the right side panel;

a fifth flap integrally formed with the fifth margin of the right side panel;

a sixth flap integrally formed with the sixth margin of the right side panel; and a seventh flap integrally formed with the seventh margin of the top panel;

a plurality of primary coupling strips attached to the plurality of flaps, wherein each primary coupling strip having a plurality of miniature hooks, the plurality of primary coupling strips including:

a first primary coupling strip attached to the first edge of the front panel;

a second primary coupling strip attached to the second edge of the front panel;

a third primary coupling strip attached to the third edge of the front panel;

a fourth primary coupling strip attached to the fourth edge of the back panel;

a fifth primary coupling strip attached to the fifth edge of the back panel;

a sixth primary coupling strip attached to the sixth edge of the top panel; and a seventh primary coupling strip attached to the seventh edge of the top panel;

a plurality of complementary coupling strips attached to the jacket, each complementary coupling strip having a plurality of miniature loops, wherein when the plurality of miniature hooks of anyone of the primary coupling strips is placed in contact with the plurality of miniature loops of anyone of the complementary coupling strips then a portion of the plurality of miniature hooks become entangled with a portion of the miniature loops, wherein the plurality of complementary coupling strips including:

a first complementary coupling strip attached to the first margin of the left side panel;

a second complementary coupling strip attached to the second margin of the left side panel;

a third complementary coupling strip attached to the third margin of the left side panel;

a fourth complementary coupling strip attached to the fourth margin of the left side panel;

a fifth complementary coupling strip attached to the fifth margin of the left side panel;

a sixth complementary coupling strip attached to the sixth margin of the left side panel; and a seventh complementary coupling strip attached to the seventh margin of the left side panel;

a plurality of straps attached to the jacket, wherein the plurality of straps comprising:

a left strap attached to the left side panel; and a right strap attached to the right side panel; and a buckle attached to one of the straps of the plurality of straps, wherein the buckle is attachable to the other strap of the plurality of straps;

laying out the device onto a flat table top so that the device is substantially flat;

getting the box;

placing the box onto the bottom panel of the flattened device;

wrapping the jacket around the box to enshroud the jacket around the box;

contacting the primary coupling strips with the complementary coupling strips of the device when the jacket is wrapped around the box to locked the jacket around the box;

buckling up the buckle to the other strap of the plurality of straps when the jacket is locked around the box;

carrying the device from one location to another location when the jacket is locked around the box and the buckle is buckled up to the other strap;

lowering the device down onto a flat surface, said lowering step performed subsequent to said carrying step;

unbuckling the buckled up buckle from the other strap of the plurality of straps when the jacket is locked around the box and when the device is lowered onto the flat surface;

disconnecting the contacted primary coupling strips from the complementary coupling strips of the device when the jacket is wrapped around the box and when the device is lowered onto the flat surface;

unwrapping the jacket from around the box when the primary coupling strips of the device are disconnected from the complementary coupling strips of the device, said unwrapping step performed subsequent to said disconnecting step;

lifting up the box, said lifting step performed subsequent to said unwrapping step;

folding up the device, said folding step performed subsequent to said lifting step; and tying the straps around the folded up device.

* * * * *